United States Patent [19]

Bloys et al.

[11] Patent Number: 4,608,740

[45] Date of Patent: Sep. 2, 1986

[54] RAIL UPHOLSTERER

[76] Inventors: David W. Bloys; Dale W. Boyce, both of 221 26th St., Bldg. 4C, Lubbock, Tex. 79404

[21] Appl. No.: 616,620

[22] Filed: Jun. 4, 1984

[51] Int. Cl.[4] ..... B68G 7/04

[52] U.S. Cl. ..... 29/429; 29/91.1; 29/91.5; 29/448; 156/201; 156/202; 227/99

[58] Field of Search ..... 29/91.1, 91.5, 91.7, 29/91.6, 429, 430, 431, 432, 448; 227/99; 297/DIG. 1; 156/201, 202; 5/451, 450

[56] References Cited

U.S. PATENT DOCUMENTS

| | | | |
|---|---|---|---|
| 3,086,209 | 4/1963 | Kamborian | 29/429 |
| 3,250,077 | 5/1966 | Ede | 29/429 X |
| 3,491,721 | 1/1970 | Gill et al. | 29/430 X |
| 3,617,421 | 11/1971 | Gray | 156/202 X |
| 3,699,626 | 10/1972 | Roth | 29/243.58 X |
| 4,155,127 | 5/1979 | Seiderman | 29/432 X |

FOREIGN PATENT DOCUMENTS

| | | | |
|---|---|---|---|
| 1485526 | 7/1969 | Fed. Rep. of Germany | 29/91.1 |
| 150187 | 8/1981 | Fed. Rep. of Germany | 29/91.5 |
| 3027065 | 2/1982 | Fed. Rep. of Germany | 29/91.5 |

*Primary Examiner*—Mark Rosenbaum
*Assistant Examiner*—Joseph M. Gorski
*Attorney, Agent, or Firm*—Wendell Coffee; Montgomery W. Smith

[57] ABSTRACT

A layer of padding is centered on a sheet of upholstery material. A rail is centered top down on the layer, and this feed assembly is moved continuously along a feed path by driven rotating rollers contacting the rail. The rail is forced by the roller toward a smooth slide face, which presses the sheet and layer against the rail top. The sheet slides along the smooth slide face. Smooth faced fences have inclined edges that progressively fold, pull taut, and then press the sheet toward the rail, compressing the layer. Guides with smooth faces and inclined edges fold the remaining sheet against the rail. The edges of the sheet are stapled or glued to the rail, producing a cap or padded rail with a taut, uniform upholstery covering. The staples or glue is inserted when the feed assembly has moved a desired distance along the feed path.

2 Claims, 14 Drawing Figures

RAIL UPHOLSTERER

BACKGROUND OF THE INVENTION

1. Field of the Invention

This invention relates to upholstering rigid elongated members, and more particularly to upholstering waterbed rails.

2. Description of the Prior Art

Most waterbed mattresses are plastic bladders that require a surrounding frame to support and contain them. This frame is typically made of "2×8", or similar size, finished, wooden boards. The hard edges of these boards are uncomfortable when portions of the body are rested on them. Therefore, padded caps were developed to fit on top of this frame.

Such caps may be made by covering a long rail with a layer of foam rubber or other resilient padding, and tautly covering the foam rubber layer with a sheet of vinyl or other upholstery material stapled or glued to the rail. The rail is typically composed of wood or pressed wood products. The rail is typically a foursided rail or beam with a groove or slot in the rail bottom that fits over the waterbed frame boards.

Before our invention, such upholstery work was accomplished manually, in some cases using a jig. This jig was ordinarily a U-shaped channel. The rail and padding centered on the sheet were positioned over the jig channel, and pressed down by hand to compress the foam rubber along the rail top and sides. The edges of the upholstery sheet were then manually pulled to remove the slack and wrinkles from the sheet. The sheet edges were then stapled to the rail bottom. However, this manual operation produced nonuniform products and created unacceptable wastage of materials.

Before this application was filed, a search was made in the U.S. Patent and Trademark Office. That search developed the following U.S. patents:

| | |
|---|---|
| KARPEN | 903,097 |
| STANNARD | 1,864,477 |
| KRAMER | 3,116,569 |
| ROTH | 3,699,626 |
| GORMAN | 3,896,531 |
| KARPEN | 931,313 |
| STUBNITZ | 1,940,636 |
| VILLAGRASA | 3,516,145 |
| HARDER | 3,747,178 |
| HUBBS | 3,979,807 |

Applicants do not regard these patents as particularly pertinent to their invention. However, they are brought to the attention of the Examiner because any references developed by a search might be of interest to the Office.

SUMMARY OF THE INVENTION

New Function and Surprising Results

Our invention continuously applies upholstery material over padding along an elongated rail. A sheet of upholstery and a layer of padding are progressively folded around, pulled taut, and then pressed against the rail. The sheet edges are then stapled or glued to the rail. The rail is continuously moved along the feed path while each of the above operations are performed.

The rail, sheet and layer are moved past edges inclined to the direction of rail movement. As the rail moves downstream, portions of the sheet and layer are pulled past the inclined edge to between the smooth face and the rail. The sheet is pulled taut as it folds around the edges, and the smooth faces press the sheet and layer against the rail.

Each staple or fastener or glue is inserted responsive to movement of the rail a desired distance along the feed path thus spacing the staples or glue uniformly along the rail.

The continuous drive mechanism of my invention preferably incorporates rollers connected to a motor, such that the rollers engage the rail and push it along the feed path as the rollers are rotated.

Thus, it may seen that the function of the total combination far exceeds the sum of the functions of the individual elements, such as plates, rollers, motors, brackets, etc.

OBJECTS OF THIS INVENTION

An object of this invention is to upholster a rigid, elongated member.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
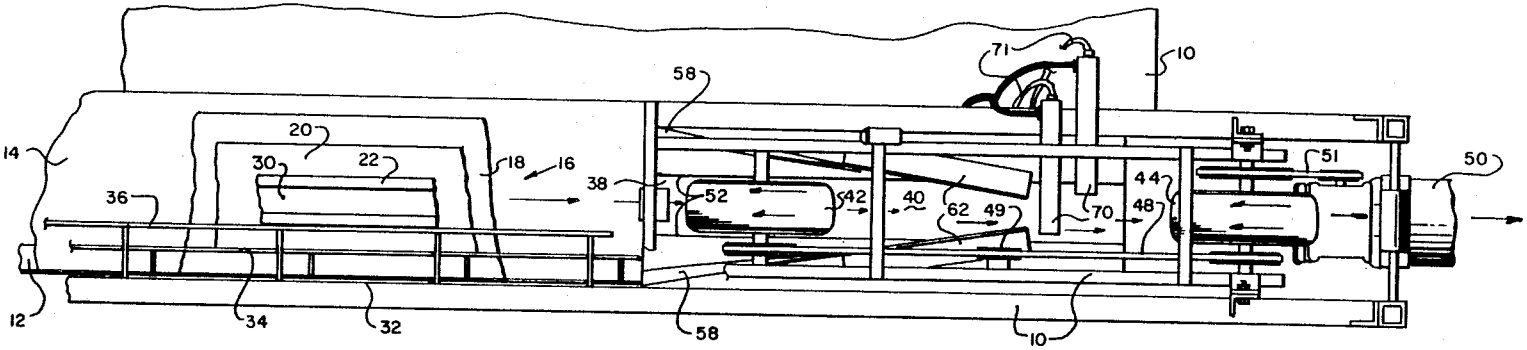
FIG. 1 is a top plan view of an upholsterer according to our invention.

An upholsterer according to our invention preferably includes frame 10, resting on, and preferably attached to a floor (not shown). Stand 12 is associated with the frame and may be integral therewith. The stand 12 has table or planar surface 14 which supports a feed assembly 16. The feed assembly 16 includes sheet 18, layer 20, and rail 22.

The sheet 18 is a foldable long, narrow sheet of upholstery material, such as vinyl or fabric. It will be understood that the term "upholstery material" refers to any satisfactory sheet covering for a waterbed rail or other padded furniture item.

The layer 20 is a foldable, long narrow layer of padding, such as foam rubber or other resilient compound. The layer 20 is also preferably thicker than the sheet, and is suitable as padding or filler for the padded portions of furniture.

The layer and sheet may be somewhat stiff, so long as they are foldable. As used herein, the term "foldable" refers to material in the form of a continuous layer or sheet that is nonrigid to the extent that portions of the sheet or layer may be moved with respect to other portions of the sheet or layer.

The rail 22 is a rigid, elongated base, not necessarily square or rectangular in cross-section, as shown in most of the drawings. The rail may be of various shapes, such as that shown in FIG. 13, described later. The rail 22 has a center surface or rail top 24, side surfaces or rail sides 26 adjacent the center surface 24, and tack surfaces or rail bottoms 28 adjacent and between the side surfaces 26 and slot or groove or channel 30. The rail is formed by gluing two rail runners or chords 25 to a rail top or web or cap 27. The slot 30 receives the waterbed frame board when in place. The cross-section of the rail forms an inverted "U" when installed on the waterbed frame.

In most applications involving waterbed rails, the bottoms 28 will be substantially opposite the rail top 24 on the rail. However, it will be understood that elongated members or rails could have tack surfaces adjacent the rail top 24, as when only the rail top 24 is to be covered and padded.

The stand 12 has sheet guide 32, layer guide 34, and rail guide 36. The guides 34 and 36 project over and are spaced above the stand surface 14. The sheet guide 32 is simply a straight edge projecting above the stand surface 14 against which a side edge of the sheet 18 is placed. This aligns the sheet in desired relation to the guides 34 and 36.

The layer 20 is then placed on top of the sheet 18 with a side edge against the layer guide 34. This aligns or positions the layer 20 on the sheet 18 at a predetermined alignment.

The rail 22 is then placed top down on the layer, with a rail side abutted against the rail guide 36. This aligns or positions the rail 22 in predetermined alignment with the layer and sheet.

The sheet 18, layer 20, and rail 22 form the feed assembly 16 when stacked as described above.

Slide member 38 is connected to or preferably mounted on the frame 10. The slide member 38 has smooth surfaced slide face 40 extended along a feed path. The slide face 40 is preferably substantially the same width as the rail top 24 and flat along its length.

Drive means for continuously moving the feed assembly along the feed path are preferably in the form of drive roller 42 positioned opposite the slide face 40, drive roller 44 positioned along the feed path downstream of the slide face, and support or idler roller 46 disposed opposite the drive roller 44 along the feed path. The drive rollers 42 and 44 are spaced away from the slide face 40 and the support roller 46, respectively, a distance such that the rail 22 is engaged by the roller 42 and 44 at the rail bottoms 28.

Figure 2:
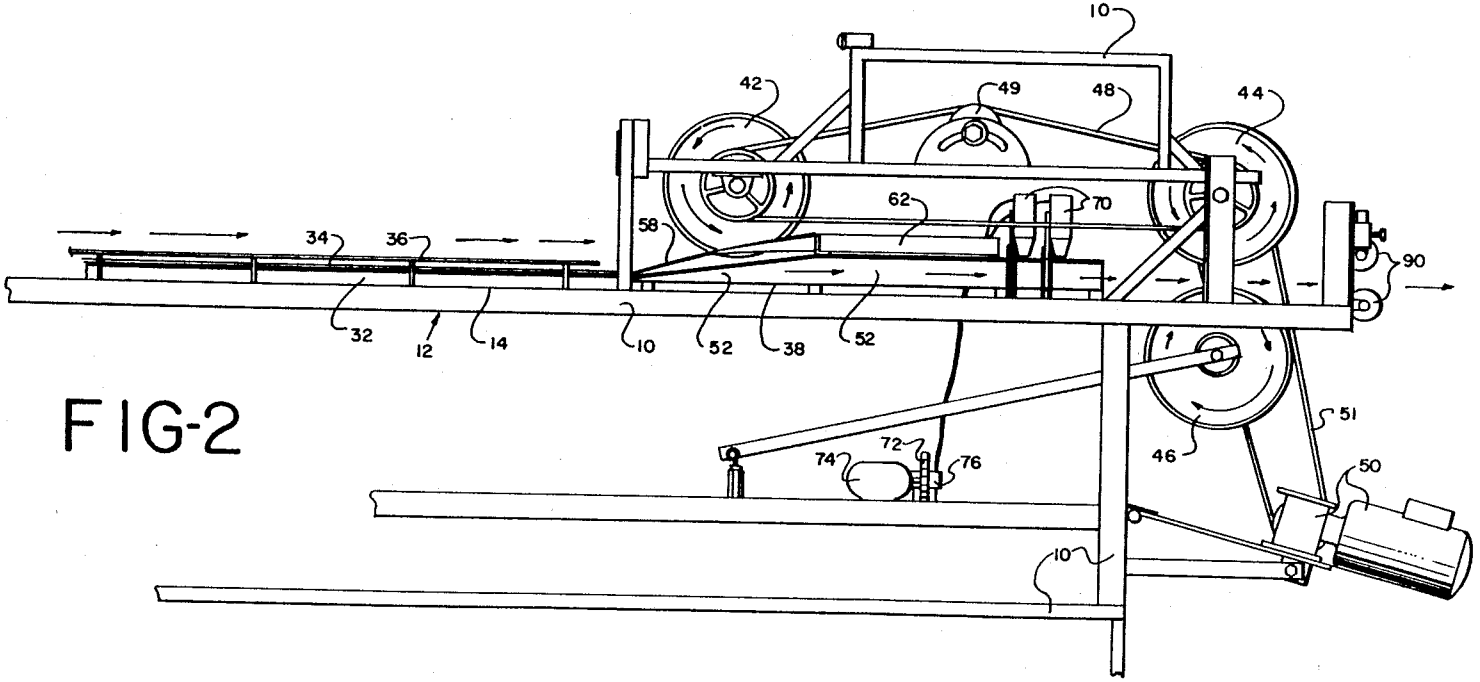
FIG. 2 is a side elevation view of the device shown in FIG. 1.

The drive rollers engage the rail, and propel it by their rotation in a downstream direction along the feed path. The direction of rotation of the rollers and the downstream direction of movement of the rail are shown by arrows in FIGS. 1 and 2.

The drive rollers 42 and 44 are connected by belt 48, maintained in tension by idler wheel 49. The drive roller 44 is connected to motor 50, mounted on the frame 10, by belt 51. The motor is preferably an electrical motor with a variable speed drive.

The drive roller 42 is in spaced relation to the slide face 40 such that when the rail 22 is contacted or engaged by the drive roller 42, the slide face 40 presses the sheet 18 and the layer 20 against the rail top 24. Thus, the drive roller 42 also forms a press member with a contact face on the wheel periphery having the desired spaced relation to the slide face. Although separate members could perform the functions of press members, such as multiple free-wheeling press rollers positioned along the feed path opposite the slide face, the rigidity of the rail 22 permits incorporation of these functions into the drive rollers 42 and 44. The multiple press rollers could also be used for a nonrigid rail.

Fences 52 are opposed and mounted on the frame adjacent the slide member. For this embodiment, with the rail sides 26 being flat and normal to the rail top 24, the fences 52 have flat fence faces 54 thereon. The faces 54 are opposed, substantially parallel and, for the rail 22, normal to the slide face 40.

Figure 4:
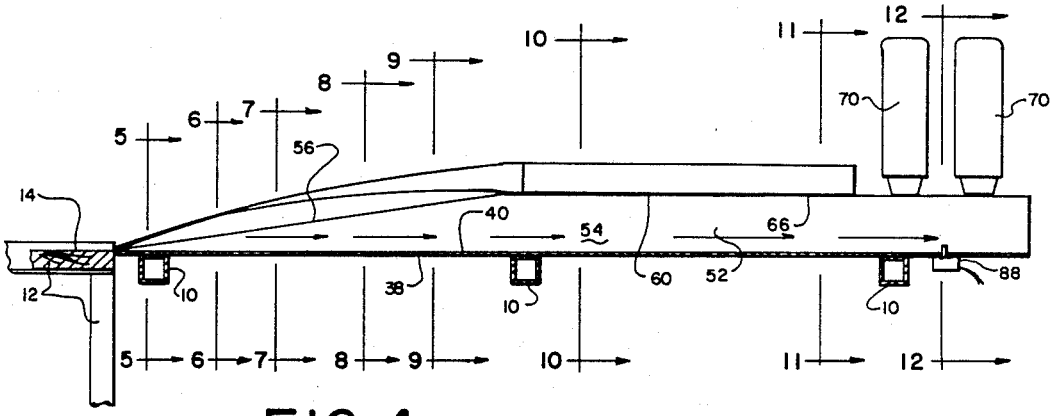
FIG. 4 is a side section view taken substantially along Line 4—4 of FIG. 3.

Inclined fence edges 56 at the top of the fences 52 are inclined with respect to the slide face 40 and the downstream direction of travel of the feed assembly. At an upstream end of the fences 52, the edges 56 are almost flush with the slide face 40, and at a downstream point along the fences 52, the edges 56 extend substantially the width of the rail sides 26 above the slide face 40. The edges 56 are preferably gradually inclined between these upstream and downstream points such that the faces 54 are somewhat triangular in shape as shown in FIG. 4.

Extensions 58 outboard of the fences 52 and the fence edges 56 position the areas of the sheet 18 for convenient folding by action of the edges 56. As shown in the drawings, the extentions preferably help maintain a smooth curvature of the sheet 18 edges as the sheet is folded.

The inclined edges 56 may be seen to perform folding, pulling, and pressing functions. The "X" point shown on the cross-section of the sheet 18 in FIGS. 5, 6, 7, 8, and 9, is used as a reference.

Figure 5:
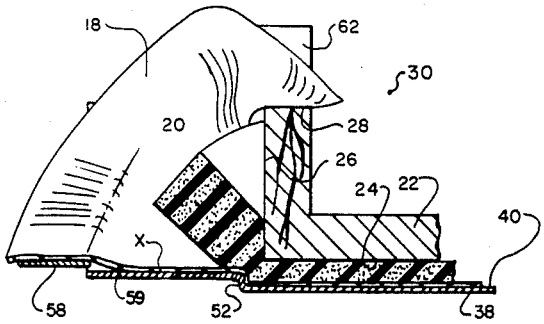
FIG. 5 is an end section view taken substantially along Line 5—5 of FIG. 4.
Figure 6:
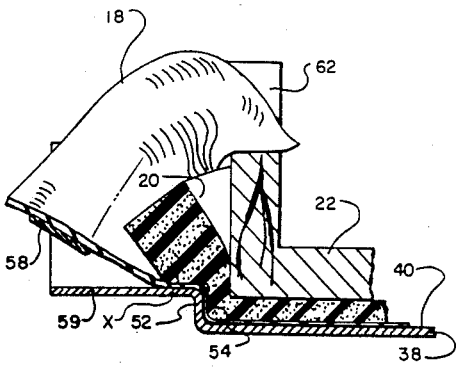
FIG. 6 is a section view taken substantially along Line 6—6 of FIG. 4.

As shown in FIG. 5, when it is near the upstream end of the fences the area about the "X" point lays flat on the extensions 58, slightly above the level of the slide face. As shown in FIG. 6, downstream movemement of the feed assembly and the change in position of the extension 58 moves the area about the "X" point above the level of the slide face and nearer the rail 22.

Figure 7:
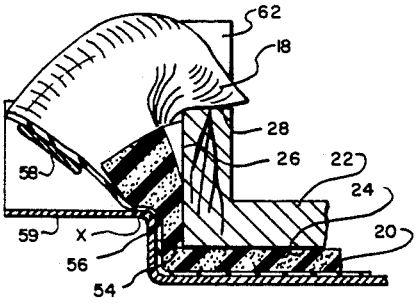
FIG. 7 is an end section view taken substantially along Line 7—7 of FIG. 4.

As shown in FIG. 7, further downstream movement of the feed assembly moves the area about the "X" point nearer the rail side and proximate the inclined fence edge 56. The portion of the layer 20 that is not pulled beneath the face 54 is uncompressed, whereas the spaced relation of the fence faces 54 causes the foam rubber layer 20 between the fence face 54 and the rail side to be somewhat compressed.

Figure 8:
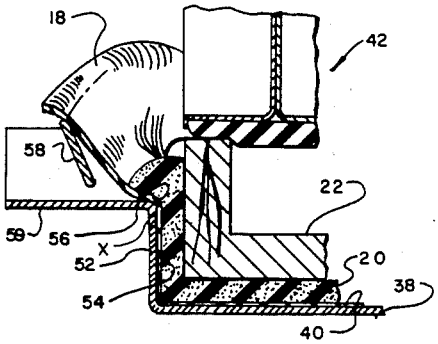
FIG. 8 is an end section view taken substantially along Line 8—8 of FIG. 4.

As shown in FIG. 8, the area about the "X" point is pulled just below the fence edge 56 by downstream movement of the feed assembly. Comparison of positions of the "X" point, and area of the sheet 18 about the "X" point, between FIGS. 7 and 8 reveals that the resiliency of the layer 20, and the angle of the sheet 18 on either side of the edge 56, causes the sheet 18 to be pulled taut as the sheet 18 deflects around the edge 56. This automatic pulling effect insures that any slack in the upholstery sheet 18 caused by the compression and reduced volume of the layer 20 about the rail 22 is taken up so that the sheet 18 is tautly pulled around the layer 20.

The area about the "X" point of the sheet 18 may also be seen to be nearer or more proximate the rail side in FIG. 8 than in FIG. 7 because of the compression of the layer 20 as described above.

Figure 9:
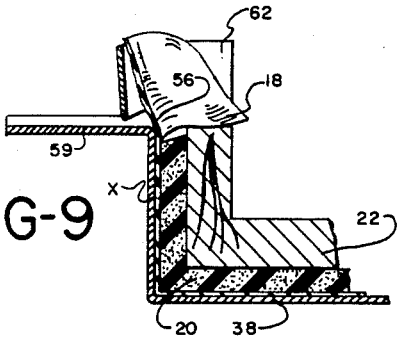
FIG. 9 is an end section view taken substantially along Line 9—9 of FIG. 4.

FIG. 9 shows the X point fully beneath the edge 56 and sliding along the fence face 54. FIG. 9 also shows the transition of the folding operation from the fences to edge guides 62.

The fences 52 and fence faces 54 extend further along the feed path downstream of the inclined edges 56, with level fence edges 60 parallel to the slide face. The fence faces 54 downstream of the edges 56 are substantially the same width as the rail sides 26.

Edge guides 62 are connected to the frame, preferably mounted about level with the fence edges 60. The guides 62 have guide edges 64 inclined with respect to the fence faces 60. The guide faces 66 are opposed, parallel, and equidistant from the slide face 40 for the rectangular cross-sectioned rail 22. The guide faces 68 are preferably smooth, and spaced slightly above the rail bottoms 28 when the rail 22 is positioned along that portion of the feed path by the drive rollers 42 and 44.

Figure 10:
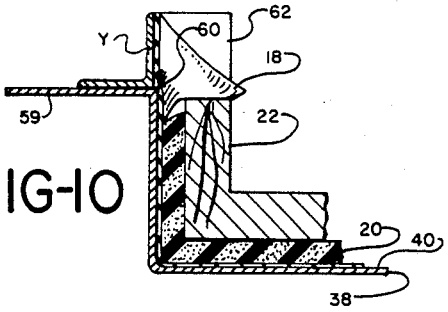
FIG. 10 is an end section view taken substantially along Line 10—10 of FIG. 4.

The edges 64 function equivalently to the fence edges 56. As shown in FIG. 10, the area of the sheet 18 about a "Y" point is positioned substantially normal to the rail bottoms above the fence edges 60.

Figure 11:
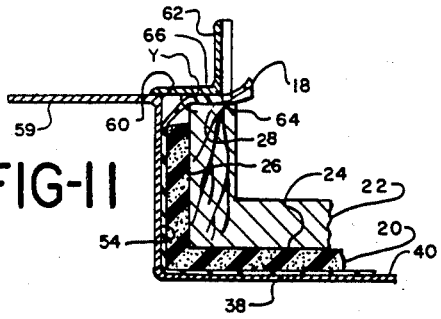
FIG. 11 is an end section view taken substantially along Line 11—11 of FIG. 4.

In FIG. 11, the area about the "Y" point has been moved beneath the guide face 62 past the inclined guide edges 64 by downstream movement of the feed assembly. The faces 62 maintain the sheet 18 flat against the rail bottoms.

We prefer not to extend the layer 20 over the rail bottoms when tacking or stapling the upholstery to the rail. However, it will be understood that if desired, the guides could be spaced above the slide face 40 a distance greater than that shown in the drawings to accommodate the thickness of a layer 20. However, for the embodiment of the feed assembly and upholsterer shown, we prefer to position the guide faces 66 so that the sheet is maintained flat against the rail bottom.

Fastener means for applying fasteners to affix the edge areas of the sheet 18 to the rail bottoms, in the form of pneumatically operated stapler guns 70, are positioned above the rail bottoms 28 along the feed path immediately downstream of the guides 62. Hoses 71 connect a source of compressed air (not shown) to the stapler guns 70. Of course, other fasteners, such as tacks, nails, glue, tape, heat treatment or any other device, process or combination thereof for affixing the sheet to the rail, and means of inserting or applying such fasteners, could be employed.

The fences and slide member 38 preferably extend along the feed path even with, and preferably just downstream of, the stapler guns 70. The pressure, and compression of the layer 20, is maintained on the sheet and layer contiguous with the rail top and sides, and prevents pulling of the sheet 18 away from the rail bottoms before stapling can be accomplished.

Figure 3:
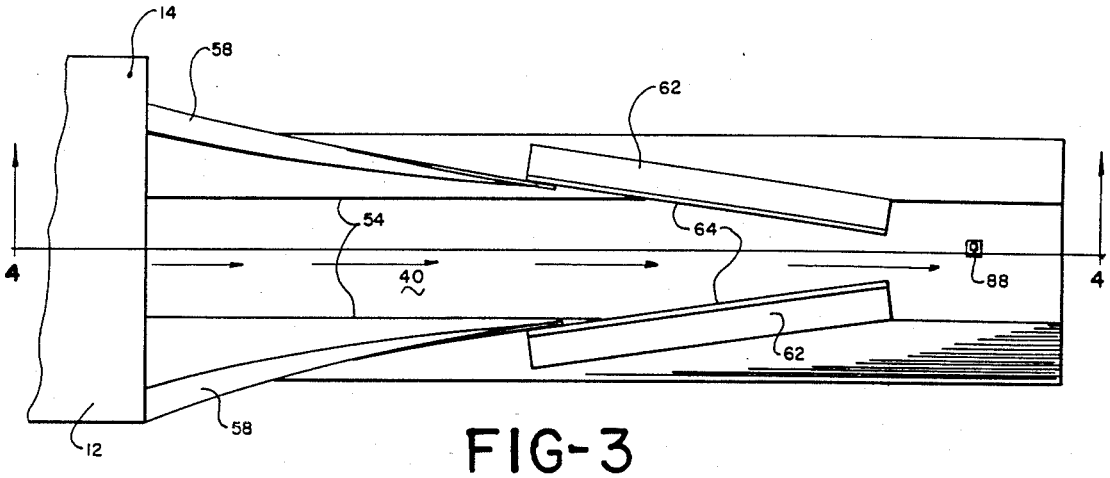
FIG. 3 is a top plan view of the fence and guide structure of the upholsterer.
Figure 12:
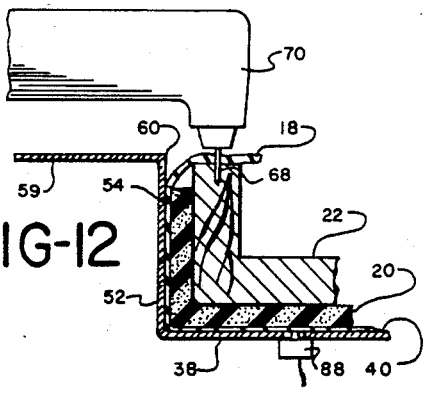
FIG. 12 is an end section view taken substantially along Line 12—12 of FIG. 4.

The stapler guns 70 are preferably positioned over the rail bottoms, as shown in FIG. 12, immediately downstream of the guides, as shown in FIGS. 3 and 4, to insert the staples while the sheet 18 is still substantially flattened against the rail bottoms. The stapler guns preferably insert staple 68 responsive to movement of the feed assembly a certain distance along the feed path.

Figure 14:
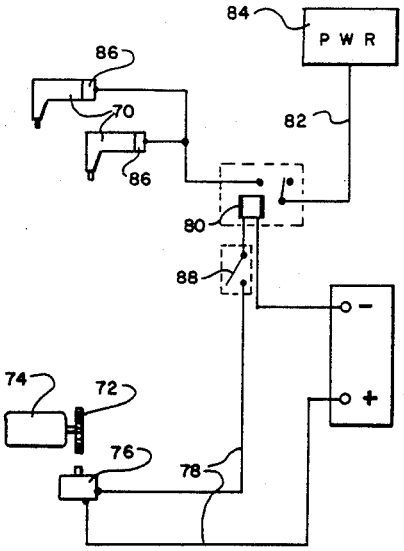
FIG. 14 is a schematic diagram of the stapler gun actuator mechanism according to our invention.

FIG. 14 schematically shows an exemplary circuit for accomplishing the injection of the staple 68 responsive to movement of the feed assembly as described. Timing wheel 72 is rotated by variable speed motor 74. Lobes or openings or other structure for interrupting a light beam, or the expulsion of gas from a valve, or other mechanical signal is used to impart an electrical current signal iniated by actuator 76 through wires 78 to the control side of relay 80. The relay controls, and is in, power lines 82 connecting a source of electrical power 84 to stapler gun triggers 86. The motor 74, wheel 72 and actuator 76, or an electronic timer, form timing means for measuring the passage of a preselected time period and initiating a pulse or electric current signal when the preselected period elapses between pulses. The relay 80 forms relay means for electically connecting the triggers of the guns 70 to a source of electrical power when the preselected period elapses between staple insertions.

The variable speed motor is preferably adjusted so that, for example, if it is desired to insert a staple every inch along the rail bottoms, the speed of the feed assembly along the feed path will cause the feed assembly to move an inch between creation of a pulse or current by the actuator, closing of the relay responsive to the electrical signal at the control side of the relay, and triggering of the stapler guns 70 to inject the staple 68.

Of course, it will be understood that this mechanical signal could also be produced by electronic timing means or any other timing device which those skilled in the art can construct, all of which are well within the scope of our invention.

Similarly, although the system described above permits great flexibility in adjusting the spacing of staples along the rail bottoms, the actuator could be directly connected to the drive means, or to a roller or other contact operated by the downstream movement of the feed assembly.

We also prefer to place contact switch 88 on the frame aligned with the stapler guns along the feed path. The switch 88 is positioned so that it will be depressed when a feed assembly is beneath the stapler guns. When the feed assembly passes beyond the stapler guns, the microswitch is released, thereby interrupting the relay control circuit and preventing the injection of staples between feed assemblies.

We have also discovered in experimentation that at times the stapling of the guns is inconsistent, leaving some staples not fully inserted into the rail bottom. Although this problem might be solved by using better stapler guns or more rigid mountings or other solutions, we have found it advantegous to connect or journal hard faced members in the form of upper and lower steel pinch rollers 90 to the frame. The pinch rollers 90 are separated or in spaced relation such that when the stapled feed assembly is passed between them, the sheet and layer along the rail top are firmly pressed against the rail top and the sheet and staples 68 along the rail bottoms are firmly pressed against the rail bottoms with the hard face of the steel pinch roller 90. With this minimal clearance of the rail between the rollers, any staples projecting more than a desired extent from the rail bottoms and sheet, will be mashed or pressed by the upper roller into the rail as desired for uniformity of appearance and function.

While it is desirable to space the drive roller and slide face, and the fence faces, apart so as to compress the foam rubber in the layer 20, it is also desirable not to space them too closely together, such that the slideable movement of the sheet 18 along the smooth faces is impeded or hindered by friction.

We also have determined that it is sometimes necessary to periodically spray silicon or other lubricant on the faces 40, 54, and 66 to reduce friction between the sheet and the faces.

The slide member 38, fences 52, and guides 64, are all preferably removable from the frame to allow substitution of other members having different shapes and or orientations to accommodate rails, layers and sheets of different shapes and compositions. The drive rollers 42 and 44 are also preferably replaceable or adjustable to permit greater or lesser spacings from the slide face 40 and support roller 46. We prefer to form the slide face and fences from a single plate of steel, as shown in the drawings. The steel plate is bent, cut, and welded to incorporate flanges 91, which structurally reinforce the slide member and fences, and provide a connection point for the edge guides 62. Thus, the entire structure shown in FIG. 3 as the slide member, fences, flanges, extensions, and edge guides are removable as a unit.

Figure 13:
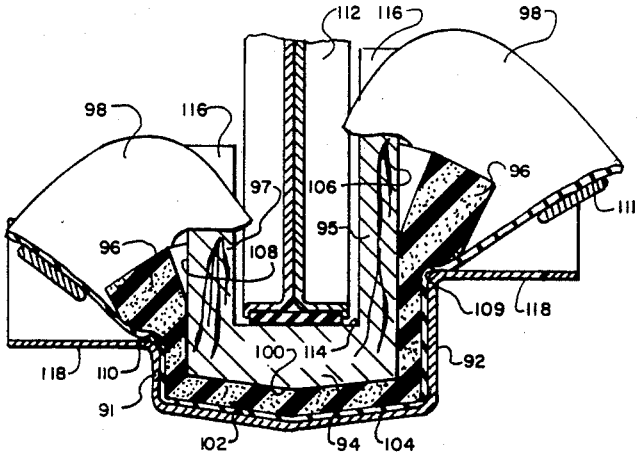
FIG. 13 is an end section similar to that shown in FIG. 7 of another embodiment of our invention using a rail with a non-rectangular cross-section.

Referring to FIG. 13, fences 91 and 92 are substituted for the fences 52 to accommodate rail 94, having wider runner 95 than runner 97, which is similar to the runners of rail 22. Likewise layer 96 and sheet 98, although similar to the layer 20 and sheet 18, are different in width. Rail top 100 is not flat as with the rail top 24, and therefore slide face 102 of slide member 104, replacing the slide member 38, is shaped to accommodate the rail top 100. It may be seen that with this shape the compression of the layer 96 will be substantially uniform over the rail top.

The fence 92 is wider, or extends further from the slide face 102, than the fences 52. This is to accommodate the width of the rail side 106, whereas rail side 108 is substantially the same as that of the rail sides 26, enabling the use of the fence 91 similar to the fence 52.

The operation and functioning of the edges and faces of the slide member 104, fences 91 and 92, and guides 116 for the feed assembly based on the rail 94 will be substantially the same for that based on the rail 22. The crosssection shown in FIG. 13 is substantially the same as that shown in FIG. 7, and a comparison of FIGS. 7 and 13 reveals that the position of inclined edge 110 of the fence 92 to the rail side 106 is proportionally the same as that of the edges 56 to the rail sides 26, although more elevated or distal of the slide face. Similarly, extensions 111 and 113 are positioned with respect to the edges 109 and 110, respectively, to perform the same functions as the extensions 58.

As shown in FIG. 13, roller 112 would also replace the drive roller 42, since for this rail and embodiment, the differing widths of the rail sides of the rail 94 would not permit stable contact of a roller such as that of roller 42 with the rail bottoms. Therefore the roller 112 is constructed to ride in and contact the rail at the bottom of slot 114 of the rail 94.

It will be understood that although our invention has been illustrated using a horizontal feed path with the rail top facing downward, the feed path could be oriented differently, and still be within the scope of our invention.

Thus, our invention not only efficiently and automatically uses a continuous process to upholster standard waterbed rails, but also is adaptable and flexible so as to accommodate and upholster waterbed rails of various sizes and shapes as desired.

The upholsterer according to our invention continuously moves the feed assembly along the feed path while pressing areas of the sheet and layer against the rail, folding adjacent areas of the sheet and layer against the rail, pulling the sheet taut, then pressing the adjacent areas against the rail, then folding edge areas of the sheet against the rail and fastening the edge areas to the rail.

It is necessary to perform the steps of pressing the areas of the sheet and layer against the rail top and rail sides during the fastening step. If these steps are not performed during this step, the resilient padding layer 20 would expand, thereby pulling the sheet 18 away from the rail sides and bottoms, introducing undesirable slack into the sheet and layer and resulting in unsatisfactory fastening of the sheet to the rail as well as loose upholstery.

It is also necessary that the pressing step, wherein the sheet and layer are pressed against the rail top, is performed during the other pressing, folding, pulling and fastening steps. If the pressure is not maintained on the sheet and layer covering the rail sides, the resilient layer will expand. If the layer and sheet are compressed after any of the above-mentioned steps, undesirable slack will be introduced into the sheet 18, causing wrinkling, increased friction with the faces 40,54, and 66, and unsatisfactory fastening.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | |
|---|---|
| 10 frame | 68 staples |
| 12 stand | 70 stapler guns |
| 14 stand surface | 71 hoses |
| 16 feed assembly | 72 timing wheel |
| 18 sheet | 74 variable speed motor |
| 20 layer | 76 actuator |
| 22 rail | 78 wires |

-continued

| | | | |
|---|---|---|---|
| 24 | rail top | 80 | relay |
| 26 | rail sides | 82 | power lines |
| 28 | rail bottoms | 84 | source of electrical power |
| 30 | slot | 86 | gun triggers |
| 32 | sheet guide | 88 | contact switch |
| 34 | layer guide | 90 | steel rollers |
| 36 | rail guide | 91 | fence |
| 38 | slide member | 92 | fence |
| 40 | slide face | 94 | rail |
| 42 | drive roller | 95 | runner |
| 44 | drive roller | 96 | layer |
| 46 | support roller | 97 | runner |
| 48 | belt | 98 | sheet |
| 49 | idler wheel | 100 | rail top |
| 50 | motor | 102 | slide face |
| 51 | belt | 104 | slide member |
| 52 | fences | 106 | rail side |
| 54 | fence faces | 108 | rail side |
| 56 | fence edges | 109 | fence edge |
| 58 | extensions | 110 | fence edge |
| 59 | flanges | 111 | extension |
| 60 | fence edges | 112 | drive roller |
| 62 | guides | 114 | slot |
| 64 | guide edges | 116 | guides |
| 66 | guide faces | 118 | flanges |

We claim as our invention:

1. A process for making a padded waterbed rail from a foldable pliable sheet of upholstery, a foldable pliable layer of padding, and a rigid elongated waterbed rail that has a longitudinal rail center surface, two rail side surfaces adjacent to and coextensive with the rail center surface, two rail tack surfaces adjacent to and coextensive with the two rail side surfaces, and a channel separating the rail tack surfaces;

said process comprising the steps of:

first positioning the layer on the sheet; then second positioning the rail on the layer, then continuously moving the sheet, layer and rail longitudinally downstream with respect to a feed path while performing the following steps;

first pressing successive areas of the sheet toward the rail center surface by use of a slide face that extends along the feed path, as the rail, layer and sheet progressively move onto the slide face;

first compressing areas of the layer between the pressed sheet and the rail center surface in response to the first pressing step;

first folding the sheet and layer against the rail side surfaces in response to progressive movement of the rail, layer, and sheet along the feed path, to produce a folded sheet and a folded layer; then first pulling the sheet and layer, over fence edges of two opposed fence faces that extend along a portion of the slide face, each fence edge being inclined as viewed in a downstream direction, such that each fence edge is proximate the slide face at one point along the feed path and distal the slide face at a point which is downstream from the one point, so that force exerted on the sheet at each fence edge is directed away from the slide face and in an upstream direction; then second pressing the folded sheet by use of the fence faces toward the rail side surfaces, as the rail, layer, and sheet move downstream past the inclined fence edges to between the fence faces; while second compressing the layer during the second pressing step above;

second folding edges of the sheet against the rail tack surfaces in response to progressive movement of the rail, layer; and sheet along the feed path; then second pulling the sheet over guide edges of two spaced apart guide faces that extend along and are spaced above a portion of the slide face, each guide edge being inclined as viewed in a downstream direction, such that each guide edge is proximate its respective fence face at one point along the feed path and distal the fence face at a point which is downstream from the one point, so that force exerted on the sheet at each guide edge is directed away from the fence face and in an upstream direction; then fastening the sheet that is folded against the rail tack surfaces during the second folding step to the rail tack surface as the rail, layer, and sheet progressively move past a fastening position along the feed path; and continuing the pressing of the sheet toward the rail center surface that was initiated with the first pressing step during and between performance of the first compressing, first folding, first pulling, second pressing, second compressing, second folding, second pulling, and fastening steps;

continuing the compressing of the layer between the sheet and the rail center surface that was initiated with the first compressing step during and between performance of the first folding, first pulling, second pressing, second compressing, second folding, second pulling, and fastening steps;

continuing the pressing of the sheet toward the rail side surfaces that was initiated with the second pressing step during and between performance of the second compressing, second folding, second pulling and fastening steps; and continuing the compressing of the layer between the sheet and the rail side surfaces that was initiated with the second compressing step during and between performance of the second folding, second pulling, and fastening steps.

2. The invention as defined in claim 1 and further including the steps of:

abutting an edge of the sheet against a prealigned sheet guide before the first positioning step;

abutting an edge of the layer against a prealigned layer guide spaced above the sheet during the first positioning step; and abutting the rail against a prealigned rail guide spaced above the layer during the second positioning step.

* * * * *